US011484184B2

(12) United States Patent
Son et al.

(10) Patent No.: US 11,484,184 B2
(45) Date of Patent: Nov. 1, 2022

(54) DISHWASHER AND METHOD OF CONTROLLING SAME

(71) Applicant: LG Electronics Inc., Seoul (KR)

(72) Inventors: Changwoo Son, Seoul (KR); Junhwa Song, Seoul (KR)

(73) Assignee: LG Electronics Inc., Seoul (KR)

( * ) Notice: Subject to any disclaimer, the term of this patent is extended or adjusted under 35 U.S.C. 154(b) by 59 days.

(21) Appl. No.: 17/115,443

(22) Filed: Dec. 8, 2020

(65) Prior Publication Data

US 2021/0177239 A1 Jun. 17, 2021

(30) Foreign Application Priority Data

Dec. 11, 2019 (KR) ..... 10-2019-0164714
Dec. 11, 2019 (KR) ..... 10-2019-0164715

(51) Int. Cl.

| | |
|---|---|
| ***A47L 15/42*** | (2006.01) |
| ***A47L 15/00*** | (2006.01) |
| ***A47L 15/22*** | (2006.01) |
| ***A47L 15/46*** | (2006.01) |

(52) U.S. Cl.

CPC ..... *A47L 15/4297* (2013.01); *A47L 15/0028* (2013.01); *A47L 15/0031* (2013.01); *A47L 15/22* (2013.01); *A47L 15/4225* (2013.01); *A47L 15/46* (2013.01); *A47L 2401/10* (2013.01); *A47L 2501/01* (2013.01);

(Continued)

(58) Field of Classification Search

CPC .. A47L 15/0028; A47L 15/0031; A47L 15/22; A47L 15/4225; A47L 15/4297; A47L 15/46; A47L 2401/10; A47L 2501/01; A47L 2501/02; A47L 2501/20; A47L 2501/30; A47L 15/0049; A47L 2501/03

See application file for complete search history.

(56) References Cited

U.S. PATENT DOCUMENTS

2007/0151584 A1* 7/2007 Omachi ..... A47L 15/4244 134/198
2019/0000297 A1 1/2019 Cho

FOREIGN PATENT DOCUMENTS

DE 19629806 1/1998
DE 19629806 A1 * 1/1998 ..... A47L 15/4297
DE 19638514 3/1998

(Continued)

OTHER PUBLICATIONS

JP2012-125495A machine translation (Year: 2012).*

(Continued)

*Primary Examiner* — Douglas Lee
(74) *Attorney, Agent, or Firm* — Fish & Richardson P.C.

(57) ABSTRACT

The present disclosure relates to a dishwasher and a method of controlling the same. The dishwasher may determine an amount of foam in a wash space using a turbidity sensor measuring a turbidity value of wash water. Additionally, the dishwasher may perform a foam removal operation based on the amount of the foam in the wash space. In this case, the turbidity value measured by the turbidity sensor may be used. The foam removal operation may include a drainage operation, a water supply operation, and a wash operation that are consecutively performed, and may be performed in one or more of a pre-wash course, a main wash course, and a heating and rinsing course.

20 Claims, 7 Drawing Sheets

(52) U.S. Cl.
CPC ..... *A47L 2501/02* (2013.01); *A47L 2501/20* (2013.01); *A47L 2501/30* (2013.01)

(56) References Cited

FOREIGN PATENT DOCUMENTS

| | | | | |
|---|---|---|---|---|
| DE | 19638514 A1 * | 3/1998 | ..... | A47L 15/0021 |
| DE | 102018002424 | 9/2019 | | |
| EP | 2206457 | 7/2010 | | |
| JP | 2012125495 A * | 7/2012 | | |
| KR | 1020190004151 | 1/2011 | | |

OTHER PUBLICATIONS

DE19629806A1 machine translation (Year: 1998).*
DE19638514A1 machine translation (Year: 1998).*
EP Extended European Search Report in European Appln. No. 20212828.6 dated Apr. 26, 2021, 10 pages.

* cited by examiner

DISHWASHER AND METHOD OF CONTROLLING SAME

CROSS-REFERENCE TO RELATED APPLICATIONS

This application claims priority to and the benefit of Korean Patent Applications No. 10-2019-0164714, and No. 10-2019-0164715 filed in Korea on Dec. 11, 2019, the disclosure of which is incorporated herein by reference in its entirety.

TECHNICAL FIELD

Disclosed herein are a dishwasher and a method of controlling the same.

BACKGROUND

Dishwashers are home appliances that can spray wash water to an object to be washed such as tableware or cooking utensils, for example, and remove foreign substances left on the object to be washed.

A dishwasher includes a tub providing a wash space, a rack provided in the tub and configured to accommodate tableware, a spray arm configured to spray wash water to the rack, a sump configured to store wash water, and a wash pump configured to supply the wash water, stored in the sump, to the spray arm.

The wash water moves to the spray arm as a result of a pump of the wash pump installed in the sump, and the wash water moved to the spray arm is sprayed through a spray hole formed at the spray arm at high pressure. The wash water sprayed at high pressure hits a surface of an object to be washed to remove foreign substances remaining on the object to be washed.

A user needs to use detergent for a dishwasher to operate the dishwasher. However, the user can put ordinary detergent into a dispenser or the tub out of negligence or ignorance. Thus, a large amount of foam is generated in the tub.

When a large amount of foam is generated in a pre-wash course or a main wash course, the dishwasher can make operational errors, resulting in a halt to the wash operation. Further, a large amount of foam can lead to an increase in air pressure in the wash space and leakage of the wash water from a door provided at a front of the tub.

A controlling method of a dishwasher is disclosed in Korean Patent Publication No. 10-2019-0004151 as a prior art document.

SUMMARY

The present disclosure is directed to a dishwasher and a method of controlling the same that may measure an amount of foam generated in a wash space accurately and rapidly.

The present disclosure is also directed to a dishwasher and a method of controlling the same that may measure an amount of foam generated in a wash space without an additional device.

The present disclosure is also directed to a dishwasher and a method of controlling the same that may remove foam generated in a wash space within a short period of time.

The present disclosure is also directed to a dishwasher and a method of controlling the same that may prevent an increase in an amount of foam, caused by a downward movement of wash water to a bottom of a tub, when the wash water is sprayed through a top spray arm and an upper spray arm during a foam removal operation.

The present disclosure is also directed to a dishwasher and a method of controlling the same that may prevent a proceeding course and a remaining course from stopping when foam is detected and removed, thereby alleviating user inconvenience.

The present disclosure is also directed to a dishwasher and a method of controlling the same that may make no operational errors and guarantee user convenience.

Objectives of the present disclosure are not limited to the above-mentioned ones, and other objectives and advantages of the disclosure which are not mentioned can be understood from the following description, and more clearly understood from the embodiments of the disclosure. It will be readily understood that the objects and the advantages of the present disclosure can be realized by means in the patent claims and combinations thereof.

A dishwasher in one embodiment may determine an amount of foam in a wash space based on a turbidity value.

When a foam determination process is performed, at least one of information indicating that the foam determination process is performed/completed and information on extension of time for operation of the dishwasher following the foam determination process may be displayed on an external terminal device or an input interface.

A dishwasher in one embodiment may perform a foam removal operation based on an amount of foam generated in a wash space.

During the foam removal operation, the dishwasher may control a diverter valve, spray wash water only through a lower spray arm and set a spray pressure of the wash water such that the wash water is not sprayed over a lower surface of a lower rack.

Additionally, during the foam removal operation, at least one of information indicating the foam removal operation is performed/completed and information on extension of time for operation of the dishwasher following the foam determination process may be displayed on an external terminal device or an input interface.

A dishwasher in one embodiment may include a tub provided with a wash space in which tableware is accommodated, a sump disposed in a lower portion of the wash space and configured to store wash water, a turbidity sensor disposed in the sump and configured to sense a turbidity value of the wash water, and a determiner configured to determine an amount of foam in the wash space based on the turbidity value.

A method of controlling a dishwasher in one embodiment may include measuring, by a turbidity sensor disposed in a sump, a turbidity value of wash water stored in the sump, and determining, by a determiner, an amount of foam in a wash space based on the turbidity value.

According to the present disclosure, an amount of foam generated in the wash space may be measured accurately and rapidly.

According to the disclosure, an amount of foam generated in the wash space may be measured without an additional device.

According to the disclosure, deterioration in wash performance, caused by a large amount of foam, may be prevented.

According to the disclosure, leakage of wash water, caused by a large amount of foam, may be prevented.

According to the disclosure, foam generated in the wash space may be removed within a short period of time.

According to the disclosure, an increase in an amount of foam, caused by a downward movement of wash water to a bottom of the tub, may be prevented when the wash water is sprayed through a top spray arm and an upper spray arm during a foam removal operation.

According to the disclosure, a proceeding course and a remaining course may be prevented from stopping when foam is detected and removed, thereby alleviating user inconvenience.

According to the disclosure, operational errors may not be made and user convenience may be guaranteed.

Specific effects are described along with the above-described effects in the section of detailed description.

BRIEF DESCRIPTION OF DRAWINGS

The accompanying drawings constitute a part of this specification, illustrate one or more embodiments of the present disclosure, and together with the specification, explain the present disclosure, wherein.

DETAILED DESCRIPTION

Figure 1:
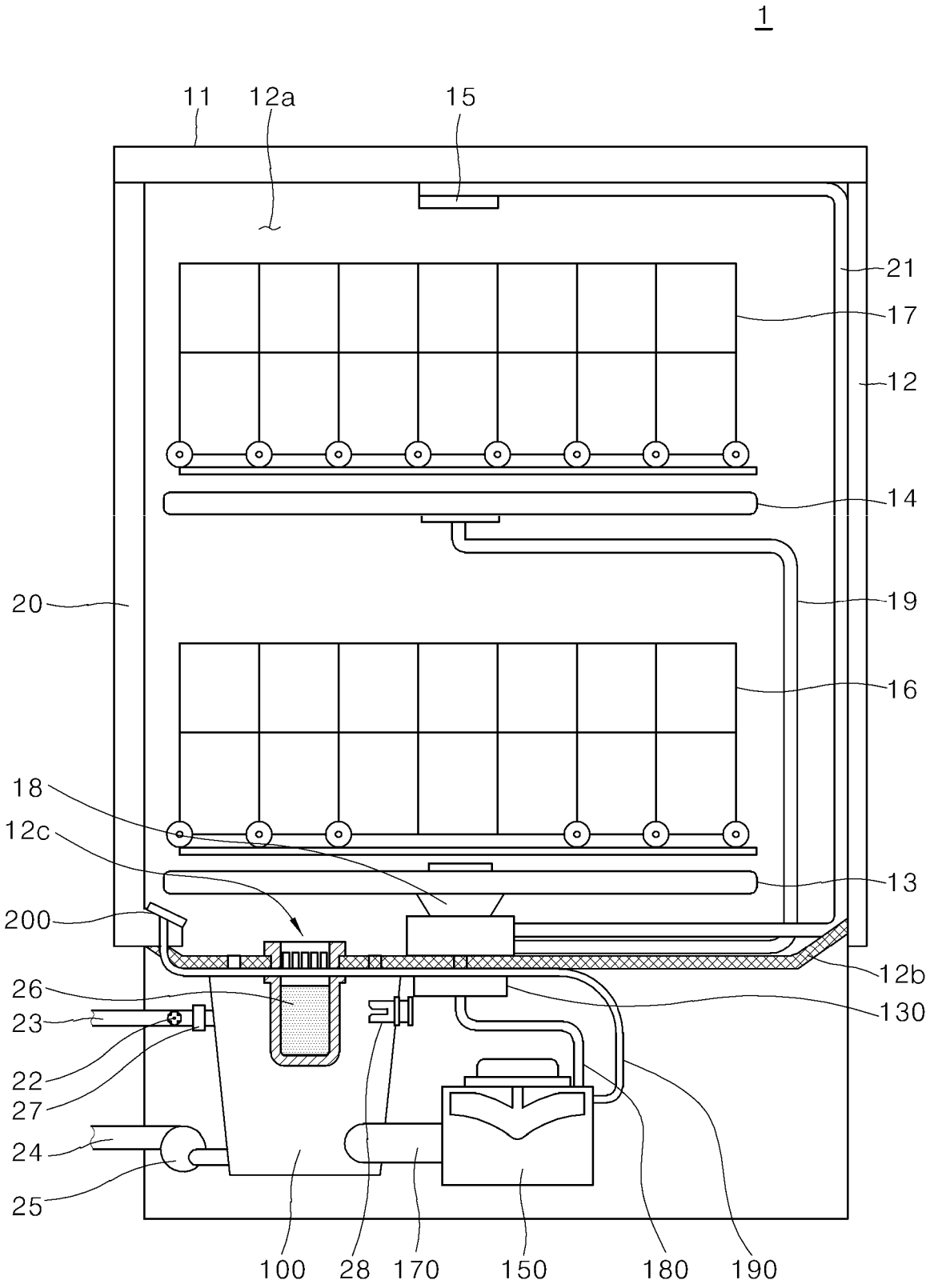
FIG. 1 is a view showing a schematic shape of an example dishwasher.

The above-described aspects, features and advantages are specifically described hereunder with reference to the accompanying drawings such that one having ordinary skill in the art to which the present disclosure pertains may easily implement the technical spirit in the disclosure. In description of the disclosure, detailed description of known technologies in relation to the disclosure is omitted if it is deemed to make the gist of the disclosure unnecessarily vague. Below, preferred embodiments according to the disclosure are specifically described. Throughout the specification, identical reference numerals may denote identical or similar components.

It should be understood that the terms "first", "second" and the like, are used herein only to distinguish one component from another component. Thus, the components should not be limited by the terms. For instance, a first component may be as a second component, and similarly, a second component may be a first component.

When any one component is described as being "in an upper portion (or a lower portion)" of a component, or "on (or under)" the component, any one component may be placed on the upper surface (or the lower surface) of the component, and an additional component may be interposed between the component and any one component placed on (or under) the component.

It should be noted that, when any one component is "connected," "coupled" or "connected" to a component, any one component may be directly "connected," "coupled," and "connected" to the component or "connected", "coupled", and "connected" to the component through an additional component.

Throughout the specification, each component may be provided as a single one or a plurality of ones, unless explicitly described otherwise.

The singular forms "a", "an" and "the" are intended to include the plural forms as well, unless explicitly indicated otherwise. It should be further understood that the terms "comprise" or "have," when used in this specification, should not be interpreted as necessarily including stated components or steps but may be interpreted as including some of the stated components or steps or should be interpreted as further including additional components or steps.

The terms "A and/or B" as used herein include may denote A, B or A and B, and the terms "C to D" may denote greater than C and less than D, unless stated to the contrary.

Below, a dishwasher according to some embodiments is described.

Figure 2:
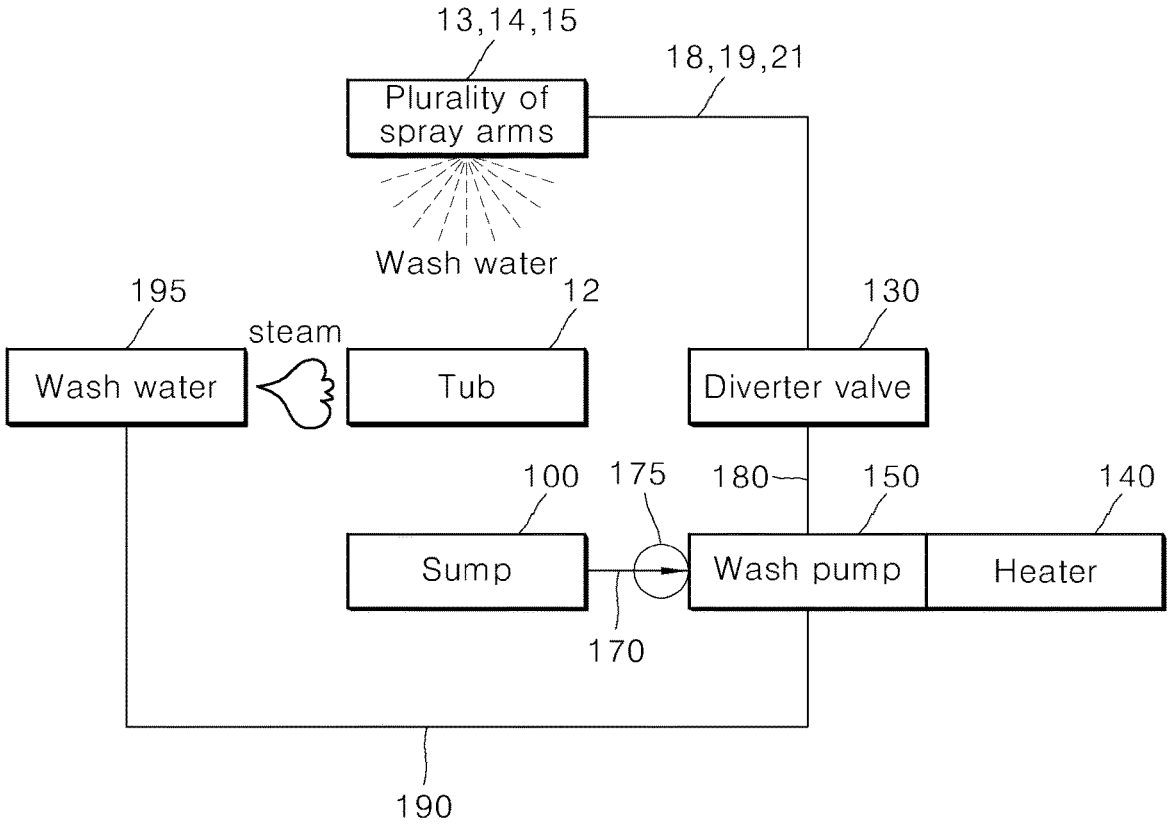
FIG. 2 is a block diagram showing an example dishwasher.

FIG. 1 is a view showing a schematic shape of an example dishwasher. FIG. 2 is a block diagram showing an example dishwasher.

Referring to FIGS. 1 and 2, the dishwasher 1 may include a case 11, a tub 12, a door 20, a sump 100, a plurality of spray arms 13, 14, 15, a wash pump 150, a heater 140, a check valve 175, a steam nozzle 195, a diverter valve 130, a water supply valve 22, a flow meter 27, and a drainage pump 25. Though not illustrated in FIGS. 1 and 2, the dishwasher 1 may include a controller.

The case 11 may form an exterior of the dishwasher 1.

The tub 12 may be disposed in the case 11 and be formed into a cuboid, a front of which is open. The tub 12 may be provided with a wash space 12*a*, in which an object to be washed is accommodated, therein.

The door 20 may be disposed at the front of the tub 12 and may open and close the wash space 12*a*.

The sump 100 may be disposed at a lower side of the tub 12 and store wash water. A turbidity sensor 28 may be disposed in the sump 100.

The plurality of spray arms 13, 14, 15 may spray wash water to the wash space 12*a*.

The wash pump 150 may supply wash water, stored in the sump 100, to the plurality of spray arms 13, 14, 15.

The heater 140 may beat wash water in the wash pump 150.

The check valve 175 may be disposed between the sump 100 and the wash pump 150 and allow wash water to flow from the sump 100 to the wash pump 150.

The steam nozzle 195 may be disposes at the door 20 and discharge steam, generated in the wash pump 150, into the tub 12.

The diverter valve 130 may optionally connect the wash pump 150 and at least one of the plurality of spray arms 13, 14, 15.

The water supply valve 22 may allow wash water, supplied from an external water source, to flow to the sump 100.

The flow meter 27 may measure a flow amount of wash water supplied from an external water source to the sump 100.

The drainage pump 25 may drain wash water stored in the sump 100 outwards.

The controller (not illustrated) may determine an amount of foam produced in the wash space 12*a*. A turbidity value sensed by the turbidity sensor 28 may be used and a current value of the wash pump may be additionally used, to determine an amount of foam.

The controller may control driving of components of the dishwasher 1, thereby controlling operations of the dishwasher 1. When foam is generated in the wash space 12*a*, the controller may control the operations of the dishwasher 1, i.e., the driving of the components of the dishwasher 1 to remove the foam based on an amount of the foam.

The controller may be a processor-based device. The processor may include one or more of a central processing unit, an application processor and a communication processor.

Operations and shapes of each component of the dishwasher 1 are specifically described as follows.

The tub 12 may have a cuboid shape, the front of which is open, and be provided with the wash space 12*a* therein. However, the shape of the tub 12 may not be limited and may have different shapes.

The tub 12 may be provided with a communication hole 12*c* through which wash water is introduced into the sump 100, at a bottom 12*b* thereof.

A plurality of racks 16, 17, in which an object to be washed such as tableware and the like is stored, may be disposed in the wash space 12*a*. The plurality of racks 16, 17 may include a lower rack 16 disposed in a lower portion of the wash space 12*a*, and an upper rack 17 disposed in an upper portion of the wash space 12*a*. The lower rack 16 and the upper rack 17 may be spaced apart from each other vertically, and may slide and be taken out towards the front of the tub 12.

The plurality of spray arms 13, 14, 15 may be spaced apart from each other vertically. The plurality of spray arms 13, 14, 15 may include a lower spray arm 13, an upper spray arm 14, and a top spray arm 15. The lower spray arm 13 may be disposed at a lowermost end of the wash space 12*a*, and may spray wash water toward the lower rack 16 in a bottom-up direction. The upper spray arm 14 may be disposed at an upper side of the lower spray arm 13 and may spray wash water toward the upper rack 17 in the bottom-up direction. The top spray arm 15 may be disposed at an uppermost end of the wash space 12*a* and may spray wash water in a top-down direction.

The plurality of spray arms 13, 14, 15 may receive wash water from the wash pump 150 through a plurality of spray arm connection channels 18, 19, 21. The plurality of spray arm connection channels 18, 19, 21 may include a lower spray arm connection channel 18, an upper spray arm connection channel 19, and a top spray arm connection channel 21. The lower spray arm connection channel 18 may connect to the lower spray arm 13, the upper spray arm connection channel 19 may connect to the upper spray arm 14, and the top spray arm connection channel 21 may connect to the top spray arm 15.

The sump 100 may be disposed at a lower side of the bottom 12*b* of the tub 12 and may collect wash water. The sump 100 may connect to a water supply channel 23 through which wash water supplied from an external water source flows.

The water supply valve 22 may regulate wash water supplied through the water supply channel 23 from an external water source. When the water supply valve 22 is opened, the wash water supplied from the external water source may be introduced into the sump 100 through the water supply channel 23. Accordingly, the sump 100 stores wash water supplied from an external water source and wash water sprayed into the wash space 12*a*.

The water supply channel 23 may be provided with a flow meter 27. The flow meter 27 may measure a flow amount of wash water flowing into the sump 100.

The drainage channel 24 may connect to the sump 100. The drainage channel 24 may deliver the wash water stored in the sump 100 to the outside of the dishwasher 1.

The drainage pump 25 may drain the wash water in the sump 100 through the drainage channel 24. The drainage pump 25 may include a drainage motor (not illustrated) that generates a rotational force. When the drainage pump 25 operates, the wash water stored in the sump 100 may be drained out of the case 11 through the drainage channel 24.

A filter 26 may be installed in the communication hole 12*c*, and filter contaminants from the wash water flowing from the tub 12 to the sump 100.

The turbidity sensor 28 may be disposed in the sump 100 and sense turbidity, i.e., a contamination level, of wash water. For example, the turbidity sensor 28 may be disposed at an upper end of the sump 100 with respect to a central portion of the sump 100. However, the present disclosure is not intended to limit the position of the turbidity sensor 28. The turbidity sensor 28 may be disposed in a different position in the sump 100.

Figure 3:
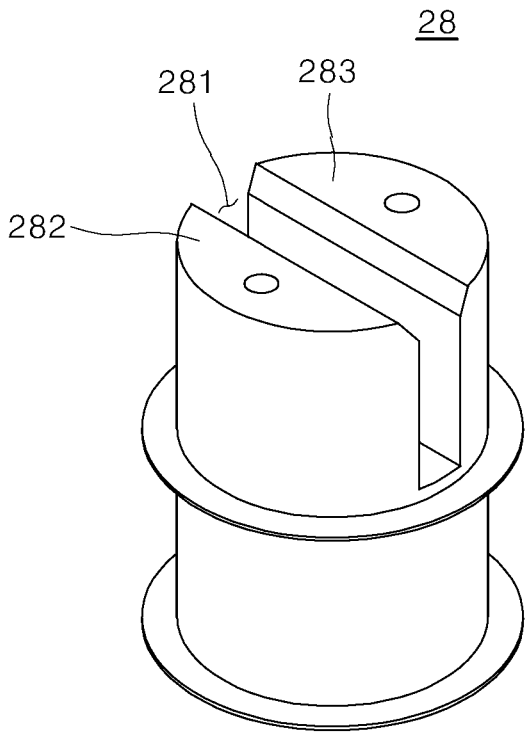
FIG. 3 is a perspective view showing an example turbidity sensor.

FIG. 3 is a perspective view showing an example turbidity sensor 28.

Referring to FIG. 3, the turbidity sensor 28 may include a sensing area 281 in which wash water flows, a light emitter 282 disposed to face the sensing area 41 and configured to emit light such that the light passes through the sensing area 41, and a light receiver 283 configured to receive the light having passed through the sensing area 41.

Wash water supplied into the sump 100 may flow in the sensing area 281 of the turbidity sensor 28. Light emitted by the light emitter 282 may transmit the wash water flowing in the sensing area 281 and the light receiver 283 may receive the light. When the light receiver 283 receives the light, the light may be converted into a predetermined voltage value, and the voltage value may be output. The voltage value may be inversely proportional to a turbidity value (a turbidity level).

When there are contaminants between the light emitter 282 and the light receiver 283, light output from the light-emitter 282 may be blocked by the contaminants, and only a part of the light output from the light emitter 282 may be delivered to the light receiver 283. Thus, when a voltage value is low, a turbidity value of wash water is high, and when a voltage value is high, a turbidity value of wash water is low.

The turbidity sensor 28 may also determine an amount of foam in the wash space 12*a*.

That is, misuse of detergent and the like may result in generation of foam in the wash space 12*a*. The generated foam may be on a surface of the wash water stored in the sump 100. Accordingly, light output from the light emitter 282 may reflect from the surface of the foam, and only a part of the light output from the light emitter 282 may be delivered to the light receiver 283. A low voltage value may denote a large amount of foam, and a high voltage value may denote a small amount of foam. Thus, a turbidity value may be proportional to an amount of foam.

To exactly measure an amount of foam, the turbidity sensor 28 may be disposed at the upper end of the sump 100 with respect to the central portion of the sump 100.

The wash pump 150 may deliver the wash water stored in the sump 100 to at least one of the plurality spray arms 13, 14, 15. The wash pump 150 may include a wash moor (not illustrated) that generates a rotational force. The wash pump 150 may connect to a diverter valve 130 through a wash water supply channel 180.

When the wash pump 150 operates, the wash water stored in the sump 100 may be introduced into the wash pump 150 through a water collection channel 170, and the introduced wash water may be delivered to the diverter valve 130 through the wash water supply channel 180. The check valve 175 may be disposed in the water collection channel 170 or between the water collection channel 170 and the wash pump 150.

The wash pump 150 may be disposed in one lateral direction of the sump 100. The wash pump 150 may connect to a steam hose 190. Stem generated in the wash pump 150 may be supplied to the steam nozzle 195 through the steam hose 190.

The heater 140 may be coupled to a lower side of the wash pump 150, and may beat wash water in the wash pump 150. When the wash pump 150 operates, the heater 140 may beat wash water flowing in the wash pump 150 to generate hot water. The heater 140 may beat the wash water in the wash pump 150 and generate steam while maintaining a level of the wash water in the wash pump 150 at a predetermined level or above. Accordingly, when the wash pump 150 operates, the heater 140 may beat the wash water in the wash pump 150 to generate steam or when the wash pump 150 stops operating, the heater 140 may heat the wash water stored in the wash pump 150 to generate steam.

The hot water generated by the heater 140 may spray into the tub 12 through at least one of the plurality of spray arms 13, 14, 15. The steam generated by the heater 140 may flow along the steam hose 190 and be discharged into the tub 12 through the steam nozzle 195.

The steam nozzle 195 may be disposed at a lower end of the door 20 and discharge steam to the wash space 12*a*. The steam discharged from the steam nozzle 195 may be delivered to the lower rack 16 and/or an object to be washed stored on the lower rack 16.

The diverter valve 130 may optionally supply wash water, delivered by the wash pump 150, to at least one of the lower spray arm 13, the upper spray arm 14 and the top spray arm 15. The diverter valve 130 may optionally connect the wash water supply channel 180 and at least one of the plurality of spray arm connection channels 18, 19, 21. The diverter valve 130 may be disposed near the sump 100.

The check valve 175 may be disposed between the sump 100 and the wash pump 150, and opened in a direction from the sump 100 to the wash pump 150. The check valve 175 may be opened to allow wash water to flow from the sump 100 to the wash pump 150, and may be closed to prevent steam from flowing from the wash pump 150 to the sump 100. A lower portion of the check valve 175 may be swivel with respect to an upper portion thereof such that the check valve 175 is opened. The check valve 175 may be disposed in the water collection channel 170 or connected between the water collection channel 170 and the wash pump 150 to open and close the water collection channel 170.

When the wash pump 150 operates and wash water flows, the check valve 175 may be opened, and when the wash pump 150 stops operating and wash water does not flow, the check valve 175 may be closed.

The check valve 175 may be opened by a flow pressure of wash water of the wash pump 150. For example, the check 175 may be a solenoid valve that is opened and closed by an electronic signal.

When the drainage pump 25 operates, wash water may flow from the wash pump 150 to the sump 100 even when the check valve 175 is closed.

The controller may determine whether foam is in the wash space 12*a*. When there is foam in the wash space 12*a*, the controller may confirm an amount of the foam. Additionally, when foam is generated in the wash space 12*a*, the controller may control an operation of the dishwasher 1 to remove the foam based on an amount of the foam.

When a user uses detergent or rinse for the dishwasher 1, a small amount of foam may be generated. On the other hand, when the user uses an ordinary detergent or rinse, a large amount of foam may be generated. A large amount of foam may result in an operational error and leakage of wash water through the door 20.

The controller may determine whether foam is in the wash space 12*a* and an amount of foam, based on specific information. Additionally, the controller may control the water supply valve 22, the wash pump 150, the drainage pump 25, the diverter valve 130 and the like to remove the foam based on the amount of the foam. The foam may be removed in one or more foam removal operations.

The specific information may include a turbidity value sensed by the turbidity sensor 28 and further include a current value of the wash pump 150. That is, the controller may use the turbidity value necessarily and optionally use the current value of the wash pump 150 to determine whether there are foam or an amount of foam. Detailed description in relation to this is provided hereunder.

The controller may control the water supply valve 22, the wash pump 150, the drainage pump 25, the diverter valve 130 and the like to wash an object to be washed. The controller may perform each administration according to a wash course selected by the user.

The wash course may include a pre-wash course, a main wash course, a rinsing course, and a heating and rinsing course. Each course may be consecutively performed.

The pre-wash course may be a course of spraying wash water to an object to be washed and preliminary removing contaminants attached to the object to be washed.

Specifically, the controller may control the water supply valve 22 to supply wash water to the sump 100 from an external water source. Additionally, the controller may control the wash pump 150 to deliver the wash water stored in the sump 100, and may control the diverter valve 130 to spray the wash water through at least one of the plurality of spray arms 13, 14, 15. The wash water sprayed through at least one of the plurality of spray arms 13, 14, 15 may allow contaminants, attached to the object to be washed, to fall on the bottom 12*b* of the tub 12, and the contaminants may be collected in the filter 26. The controller may control the drainage pump 25 to drain the wash water stored in the sump 100 outward.

The main wash course may be the dishwasher 1's main course of spraying heated wash water to an object to be washed and removing contaminants attached to the object to be washed.

Specifically, the controller may control the water supply valve 22 to supply wash water to the sump 100 from an external water source. Additionally, the controller may control the heater 140 to heat the wash water and control the wash pump 150 to spray the heated wash water through at least one of the plurality spray arms 13, 14, 15. Further, the controller may control the drainage pump 25 to drain the wash water stored in the sump 100 outward.

The rinsing course may be a course of removing the remaining contaminants attached to the object to be washed.

Specifically, the controller may control the water supply valve 22 to supply wash water to the sump 100 from an external water source. Additionally, the controller may control the wash pump 150 to spray the wash water to spray the wash water through at least one of the plurality of spray arms 13, 14, 15. The controller may control the drainage pump 25 to drain the wash water stored in the sump 100 outward.

The heating and rinsing course may be a course of spraying the heated wash water to the object to be washed and heating the object to be washed.

Specifically, the controller may control the water supply valve 22 to supply wash water to the sump 100 from an external water source. Additionally, the controller may control the heater 140 to heat the wash water and control the wash pump 150 to spray the heater water through at least one of the plurality of spray arms 13, 14, 15. Further, the controller may control the drainage pump 25 to drain the wash water stored in the sump 100 outward.

Below, methods of determining an amount of foam in the wash space 12*a* and for removing the foam based on the determined amount of the foam is described with reference to the following drawings.

1. Method of Determining Amount of Foam

Figure 4:
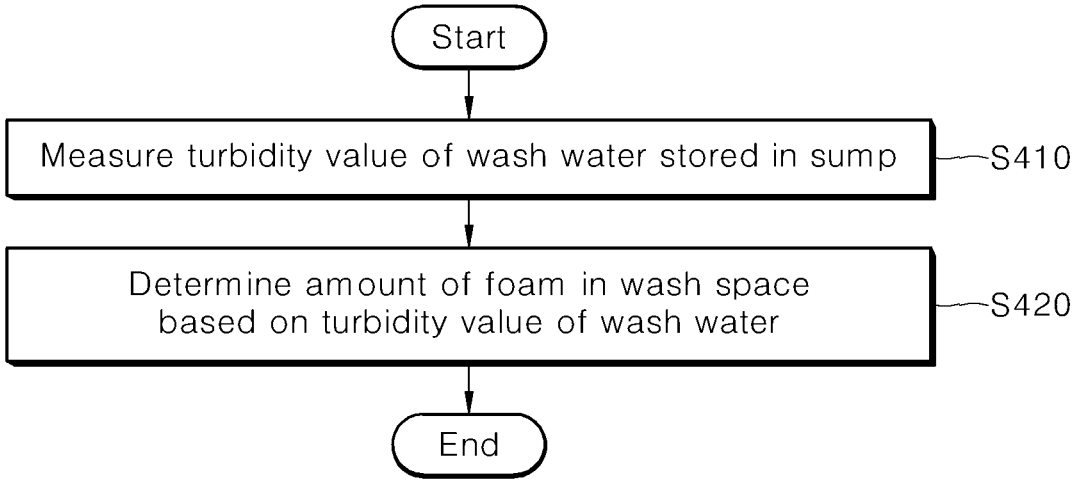
FIG. 4 and FIG. 5 are flow charts showing a method of controlling a dishwasher configured to determine an amount of foam in a wash space according to one embodiment.

FIG. 4 is a flow chart showing a method of controlling a dishwasher 1 configured to determine an amount of foam in a wash space 12*a* according to one embodiment.

The control method of the dishwasher 1 for determining an amount of foam may be carried out in at least one of the pre-wash course, the main wash course and the heating and rinsing course. For example, the control method of the dishwasher 1 for determining an amount of foam may be carried out at a start time point of each of the pre-wash course, the main wash course and the heating and rinsing course.

Each step of the control method of the dishwasher 1 for determining an amount of foam is described hereunder.

In step 410, a turbidity value of wash water stored in the sump 100 may be sensed. Step 410 may be carried out by the turbidity sensor 28.

Specifically, when detergent or rinse is used, foam may be generated in the wash space 12*a*. In this case, light rays output by the light emitter 282 of the turbidity sensor 28 may be reflected or blocked by the foam, and some of the output light rays may only be received by the light receiver 283 of the turbidity sensor 28. The light rays received by the light receiver 283 may be converted into a corresponding voltage value, and the converter voltage value may correspond to the turbidity value of the wash water. The voltage value may be inversely proportional to the turbidity value of the wash water.

In step 420, the amount of the foam in the wash space 12*a* may be determined based on the turbidity value of the wash water. Step 420 may be carried out by the controller.

The amount of the foam in the wash space 12*a* may be inversely proportional to the voltage value sensed by the turbidity sensor 28 and proportional to the turbidity value of the wash water. In other words, as the voltage value sensed by the turbidity sensor 28 becomes smaller, a larger amount of foam is in the wash space 12*a*, and, as the voltage value sensed by the turbidity sensor 28 becomes larger, a smaller amount of foam is in the wash space 12*a*.

Though not illustrated in FIG. 4, in another embodiment, the controller may further use a current value of the wash pump together with the turbidity value of the wash water to determine an amount of foam in the wash space 12*a*.

Specifically, as an amount of foam in the wash space 12*a* becomes larger, a current value of the wash pump becomes smaller due to an air pressure caused by the foam. Accordingly, the controller may primarily determine the amount of the foam in the wash space 12*a* using the current value of the wash pump, and may secondarily determine the amount of the foam in the wash space 12*a* using the turbidity value of the wash water. In this case, the amount of the foam may be determined based on the current value of the wash pump when the current value of the wash pump is a threshold current value or less.

When a large amount of foam is in the wash space 12*a*, and the amount of the foam is at a threshold or above, due to misuse of detergent and the like, an air pressure in the wash space becomes higher. Thus, the dishwasher 1 may make operational errors.

In step 420, the controller may further determine whether the amount of the foam in the wash space 12*a* is greater than a predetermined threshold amount of the foam. The threshold amount of foam may be a value set to prevent an operational error (e.g., leakage of wash water) of the dishwasher 1.

Below, a process of determining whether an amount of foam in the wash space 12*a* is greater than the threshold amount of foam is described.

Figure 5:
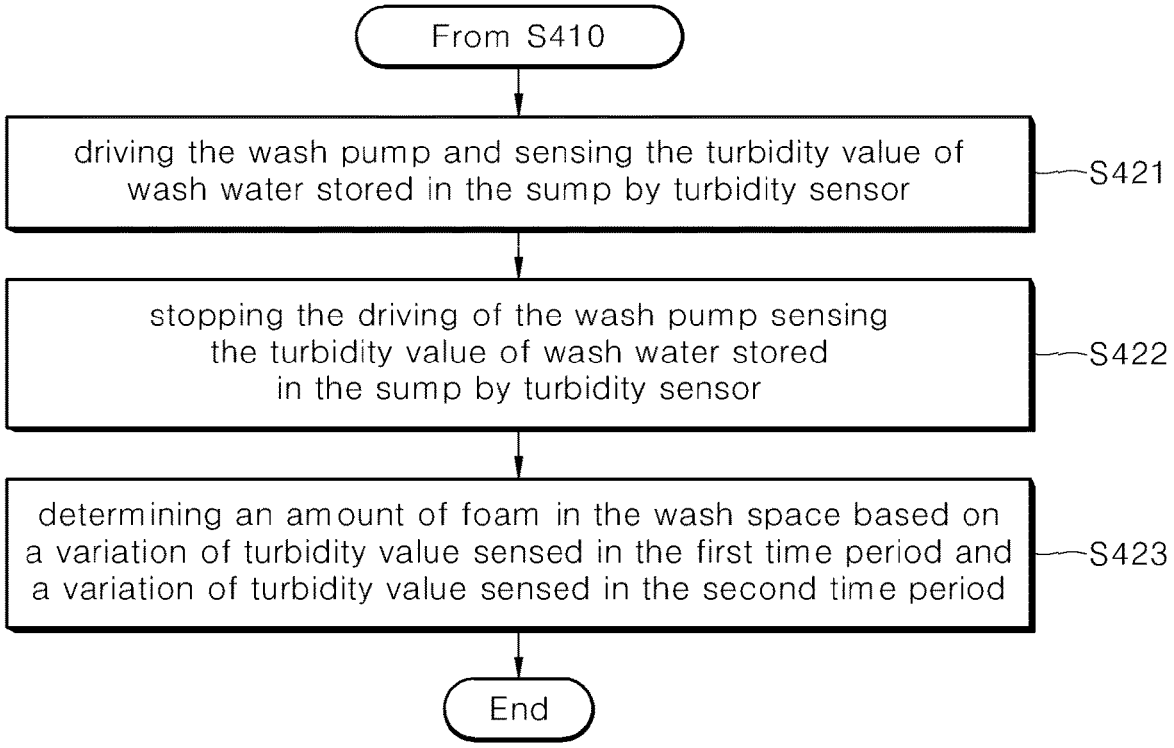

FIG. 5 is a flowchart showing a specific process of step 420.

In step 421, the wash pump 150 is driven, and the turbidity sensor 28 senses the turbidity value of the wash water stored in the sump 100. The step 421 is a step performed in a predetermined first time period.

That is, the step S421 is a step in which the turbidity sensor 28 senses the turbidity value of the wash water stored in the sump 100 when the wash pump 150 is driven.

A start time point of the first time period may be a start time point of the first course among a plurality of courses performed by the dishwasher 1. The first course may be any one of a pre-wash course, a main wash course, and a heating and rinsing course. For example, a length of the first time period may be 30 seconds but not limited.

In step 422, the driving of the wash pump 150 is stopped, and the turbidity sensor 28 senses the turbidity value of the wash water stored in the sump 100. Step 422 is a step performed in a predetermined second time period.

That is, in step S22, when the driving of the wash pump 150 is stopped, the turbidity sensor 28 senses the turbidity value of the wash water stored in the sump 100.

The second time period is a time period immediately after the first time period. For example, the length of the second time period may be 30 seconds, but not limited.

In step 423, the controller may determine an amount of foam in the wash space 12*a* based on a variation in the turbidity values sensed in the first time period and a variation in the turbidity values sensed in the second time period, and determine whether an amount of foam in the wash space 12*a* is greater than the threshold amount of foam In one embodiment, in step 423, the controller may determine that the amount of foam in the wash space 12*a* is greater than the threshold amount of foam when the variation in the turbidity values in the first time period is greater than a predetermined first threshold variation and the variation in the turbidity values in the second time period is greater than a predetermined second threshold variation. The first and second threshold variations may be values set to prevent an operation error of the dishwasher 1 (e.g., leakage of wash water).

The variation in the turbidity values in the first time period may include at least one of an average gradient of the turbidity values in the first time period and a first difference value. The first difference value may be a difference value between a turbidity value at a start time point in the first time period and a maximum value of the turbidity value in the first time period.

Similarly, the variation in the turbidity values in the second time period may include at least one of an average gradient of the turbidity values in the second time period and a second difference value. The second difference value may be a difference value between a turbidity value at a start time point in the second time period and a minimum value of the turbidity value in the second time period.

Below, the process of determining the amount of foam performed in step S23 is described in detail with reference to FIGS. 6A and 6B and 7A and 7B.

Figure 6A:
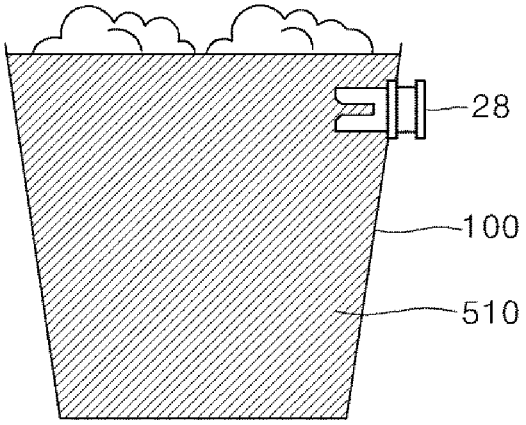
FIG. 6A is a view showing a state of the sump before first course is performed according to one embodiment.
Figure 6B:
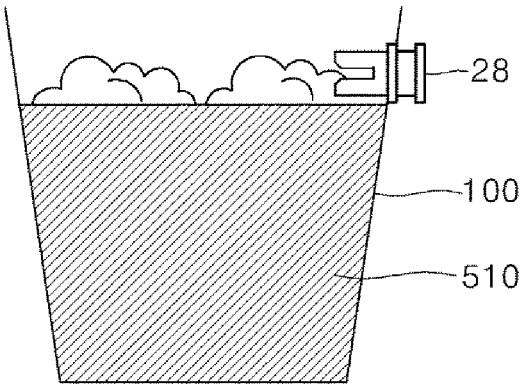
FIG. 6B is a view showing a state of the sump in first time period according to one embodiment.

FIGS. 6A and 6B are views showing a state of the sump 100 according to one embodiment.

Before the first course is performed, a detergent or rinse is injected into the wash space 12*a*. Accordingly, foam exist on a surface of the wash water 510 stored in the sump 100. This is as shown in FIG. 6A.

Thereafter, in the first time period, the wash pump 150 is driven, the wash water 510 is circulated, and a height of the wash water 510 stored in the sump 100 gradually decreases. This is as shown in FIG. 6B. Accordingly, the foam existing on the surface of the wash water 510 come down to around the turbidity sensor 28.

That is, by the driving of the wash pump 150, the height of the wash water 510 decreases as time elapses, and accordingly, the voltage value of the turbidity sensor 250 decreases rapidly, and the turbidity value of the wash water 510 increases rapidly.

Figure 7A:
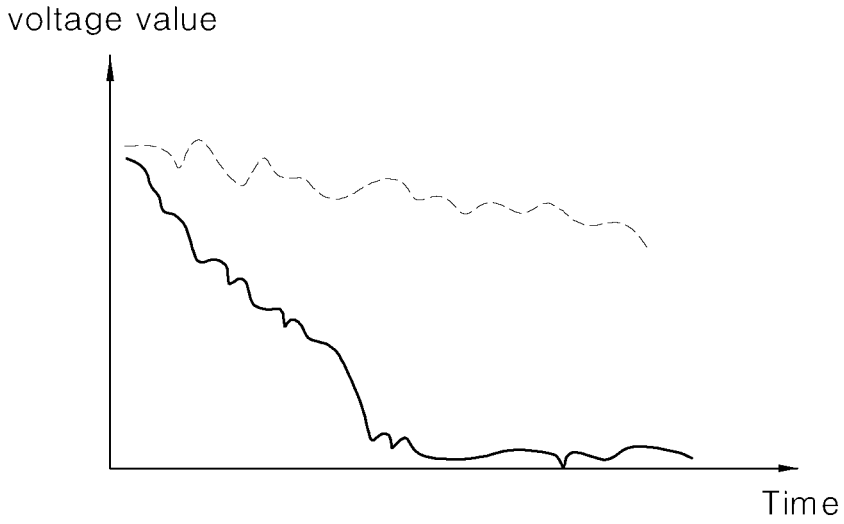
FIG. 7A is diagram illustrating a voltage value of a turbidity sensor sensed in the first and second time periods according to one embodiment.

FIG. 7A shows the voltage value of the turbidity sensor 28 sensed in the first time period.

In FIG. 7A, the full line means a voltage value of the turbidity sensor 28 in the first time period when foam exists, and the dashed line means the turbidity sensor 28 in the first time period when foam does not exist. Here, the voltage value when foam exists corresponds to "sensed voltage value", and the voltage value when foam does not exist corresponds to "reference voltage value".

Referring to FIG. 7A, in the first time period, the variation in the reference voltage value is a small variation, and the variation in the sensed voltage value is a big variation. The gradient of each of the reference voltage value and the sensing voltage value has a negative.

Here, the variation in the sensed voltage value in the first time period may include an average gradient of the sensed voltage value in the first time period and a first difference value of the sensed voltage value in the first time period. The first difference value of the sensed voltage value may be a difference value between a sensed voltage value at the start time point in the first time period and a minimum value of the sensed voltage value in the first time period.

In addition, the reference voltage value in the first time period may be defined as a first threshold voltage value corresponding to the threshold amount of the foam. The first threshold voltage value includes a first threshold voltage gradient and a first threshold voltage difference value. The first threshold voltage gradient may be the average gradient of the reference voltage value in the first time period, and the first threshold voltage difference value may be a difference value between a reference voltage value at the start time point in the first time period and a minimum value of the reference voltage value in the first time period.

Referring to FIG. 7A, it is confirmed that the average gradient of the sensing voltage value in the first time period is less than the first threshold gradient, and that the first difference value of the sensing voltage value in the first time period is less than the first threshold difference value.

Meanwhile, the voltage value of the turbidity sensor 28 is inversely proportional to the turbidity value of the wash water. Further, the turbidity value when foam is exists is referred to as "sensing turbidity value", and the turbidity value when foam is not exist is referred to as "reference turbidity value". In addition, the reference turbidity value in the first time period may be defined as a first threshold variation corresponding to the threshold amount of the foam. The first threshold variation may include a first threshold turbidity gradient and a first threshold turbidity difference value. The first threshold turbidity gradient may be the average gradient of the reference turbidity value in the first time period, and the first threshold turbidity difference value may be a difference between the reference turbidity value at the start time point in the first time period and the maximum value of the reference voltage value in the first time period.

Therefore, referring to the above description, the average gradient of the sensing turbidity value in the first time period is greater than the first threshold turbidity gradient, and the first difference value of the sensing turbidity value in the first time period is greater than the first threshold turbidity difference value.

Next, in the second time period after the first time period, the driving of the wash pump 150 is stopped, the circulation of the wash water 510 is stopped, and the height of the wash water 510 stored in the sump 100 gradually increases. This is as shown in FIG. 6A. Accordingly, foam existing on the surface of the wash water 510 rises to the top of the turbidity sensor 28.

That is, the driving of the wash pump 150 is stopped and the height of the wash water 510 increases, and accordingly, the voltage value of the turbidity sensor 28 increases rapidly, and the turbidity value of the wash water 510 decreases rapidly.

Figure 7B:
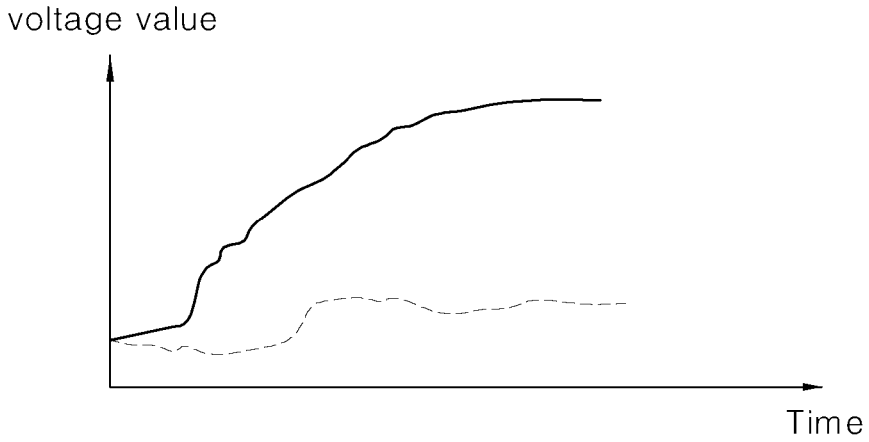
FIG. 7B is diagram illustrating a voltage value of the turbidity sensor sensed in second time periods according to one embodiment.

FIG. 7B shows the voltage value of the turbidity sensor 28 sensed in the second time period.

Referring to FIG. 7B, in the second time period, the variation in the reference voltage value is a small variation, and the variation in the sensed voltage value is a big variation. The gradient of each of the reference voltage value and the sensing voltage value has a positive.

Here, the variation in the sensed voltage value in the second time period may include an average gradient of the sensed voltage value in the second time period and a second difference value of the sensed voltage value in the second time period. The second difference value of the sensed voltage value may be a difference value between a sensed voltage value at the start time point in the second time period and a maximum value of the sensed voltage value in the second time period.

In addition, the reference voltage value in the second time period may be defined as a second threshold voltage value corresponding to the threshold amount of the foam. The second threshold voltage value includes a second threshold voltage gradient and a second threshold voltage difference value. The second threshold voltage gradient may be the average gradient of the reference voltage value in the second time period, and the second threshold voltage difference value may be a difference value between a reference voltage value at the start time point in the second time period and a maximum value of the reference voltage value in the second time period.

Referring to FIG. 7B, it is confirmed that the average gradient of the sensing voltage value in the second time period is greater than the second threshold gradient, and that the second difference value of the sensing voltage value in the second time period is greater than the second threshold difference value.

Meanwhile, the reference turbidity value in the second time period may be defined as a second threshold variation corresponding to the threshold amount of the foam. The second threshold variation may include a second threshold turbidity gradient and a second threshold turbidity difference value. The second threshold turbidity gradient may be the average gradient of the reference turbidity value in the second time period, and the second threshold turbidity difference value may be a difference between the reference turbidity value at the start time point in the second time period and the minimum value of the reference voltage value in the second time period.

Therefore, referring to the above description, the average gradient of the sensing turbidity value in the second time period is less than the second threshold turbidity gradient, and the second difference value of the sensing turbidity value in the second time period is less than the second threshold turbidity difference value.

Below, the operation of the controller performed in step 423 is described in detail with reference to the above description.

In one embodiment, when the average gradient of the turbidity value in the first time period is greater than the first threshold turbidity gradient and the average gradient of the turbidity value in the second time period is less than the second threshold turbidity gradient, the controller may determine that the amount of foam of the wash water is greater than the threshold amount of foam.

In another embodiment, when the first difference value of the turbidity value in the first time period is greater than the first threshold turbidity difference value and the average gradient of the turbidity value in the second time period is less than the second threshold turbidity gradient, the controller may determine that the amount of foam of the wash water is greater than the threshold amount of foam.

In still another embodiment, when the average gradient of the turbidity value in the first time period is greater than the first threshold turbidity gradient and the second difference value of the turbidity value in the second time period is less than the second threshold turbidity difference value, the controller may determine that the amount of foam of the wash water is greater than the threshold amount of foam.

In still another embodiment, when the first difference value of the turbidity value in the first time period is greater than the first threshold turbidity difference value and the second difference value of the turbidity value in the second time period is less than the second threshold turbidity difference value, the controller may determine that the amount of foam of the wash water is greater than the threshold amount of foam.

Meanwhile, the dishwasher 1 determines whether the amount of foam in the wash space 12*a* is greater than the threshold amount of foam by using both the variation in the turbidity value in the first time period and the variation in the turbidity value in the second time period. Accordingly, an error in determining the amount of foam may be prevented.

For example, it is assumed that there is not much foam in the wash water, and milk is on the surface of the dishes. When the milk on the dishes falls into the wash water, a turbidity value of wash water mixed with milk is similar to that of wash water with foam. However, since milk exists in all part of the wash water, the variation in the turbidity value of wash water with milk is different from the variation in the turbidity value of wash water with foam.

That is, when the wash pump 150 is driven in the first time period while milk is mixed with the wash water, the turbidity value increases rapidly. This is similar to the turbidity value of the wash water with foam. However, when the driving of the wash pump 150 is stopped in the second time period, the turbidity value of wash water with milk does not decrease rapidly. This is different from the turbidity value of the wash water with foam.

As a result, if only the variation in the turbidity value in the first time period is used, the milk may be mistaken for foam. Accordingly, the dishwasher 1 may be determine the amount of foam using both the variation in the turbidity value in the first time period and the variation in the turbidity value in the second time period.

Meanwhile, when it is determined that the amount of foam in the wash space 12*a* is less than the threshold amount of foam, the controller determines that the dishwasher 1 operates normally without error. After that, the controller controls the dishwasher 1 to continue to perform the remaining operation. (i.e., the operation of the pre-wash course, the operation of the main wash course and the operation of the heating and rinsing course).

Also, when it is determined that the amount of foam in the wash space 12*a* is greater than the threshold amount of foam, the controller determines that the operation error may occur in the dishwasher 1. After that, the controller may control the dishwasher 1 to continue to perform the remaining operation after performing the foam removal operation described below.

Though not illustrated in FIGS. 1 and 2, the dishwasher 1 may include a communicator and an input interface.

The communicator may communicate with an external terminal device (e.g., a smartphone). For example, the communicator may include a short-range communication module such as a Bluetooth module, a near field communication (NFC) module, a Wireless-Fidelity (Wi-Fi) module and the like, and a long-range communication module such as a long-term evolution (LTE) communication module, a fifth-generation (5G) communication module and the like.

The input interface may be buried into the outside of the dishwasher 1, receive a touch event from the user, and display specific information.

In this case, when a foam determination process is carried out, the controller may control the communicator to transmit, to an external terminal device, at least one of information indicating that the foam determination process is performed/completed and information on extension of time for operation of the dishwasher 1 following the foam determination process, or control the input interface to display the at least one information.

In one embodiment, the controller may determine an amount of foam in the wash space 12*a* using a learning model including one or more artificial neural networks (ANN). Detailed description in relation this is provided hereunder.

Artificial intelligence (AI) may involve an area that studies artificial intelligence or that studies methodologies of developing artificial intelligence, and machine learning may involve an area that defines a variety of problems handled in the artificial intelligence field and that studies methodologies of solving the problems. Machine learning may also be defined as an algorithm for enhancing performance concerning a job based on steady experience.

An artificial neural network (ANN), which is a model used for machine learning, may denote a model that is comprised of artificial neurons (nodes) forming a network based on a connection of synapses and that has the ability to solve problems, as a whole. The artificial neural network may be defined by a pattern of a connection between neurons of other layers, a learning process of updating model parameters, and an activation function generating an output value.

The artificial neural network may include an input layer, an output layer, and optionally one or more hidden layers. Each layer may include one or more neurons, and the artificial neural network may include synapses connecting a neuron and a neuron. In the artificial neural network, each neuron may output input signals input through synapses, weights, and values of an activation function of biases.

A model parameter may denote a parameter determined based on learning, and may include weights of connections of synapses, biases of neurons and the like. Additionally, a hyperparameter may denote a parameter that needs to be set prior to learning in a machine learning algorithm, and may include a learning rate, repetition frequency, a size of mini-batch, an initialization function and the like.

The purpose of training an artificial neural network is to determine a model parameter that minimizes a loss function. The loss function may be used as an index for determining an optimal model parameter in the process of training the artificial neural network.

Machine learning may be classified as supervised learning, unsupervised learning, and reinforcement learning depending on learning methods.

Supervised learning may involve a method of training an artificial neural network in the state in which a label is given to learning data, and a label may denote the correct answer (or result values) that has to be inferred by an artificial neural network when learning data is input to the artificial neural network.

Unsupervised learning may involve a method of training an artificial neural network in the state in which a label is not given to learning data.

Reinforcement learning may involve a method of training an agent defined in a certain environment such that the agent chooses a behavior for maximizing a cumulative reward or the order of behaviors for maximizing accumulative reward in each state.

Among artificial neural networks, machine learning implemented as a deep neural network (DNN) including a plurality of hidden layers may also be referred to as deep learning, and deep learning may be part of machine learning. Below, machine learning may include deep learning.

Referring to the above description, for the controller, an artificial neural network-based algorithm model for measuring an amount of foam in the wash space 12*a* may include an input layer including input nodes, an output layer including output nodes and one or more hidden layers disposed between the input layer and the output layer and including hidden nodes. In this case, the algorithm model may be trained by learning data, and, as a result of training, weights of edges connecting nodes and biases of the nodes may be updated.

Additionally, a turbidity value of wash water, sensed by the turbidity sensor 28, may be input to the input layer of the trained algorithm model, and an amount of foam in the wash space 12*a* may be output to the output layer of the trained algorithm model.

In summary, the dishwasher 1 according to the disclosure may determine whether foam is generated in the wash space 12*a* based on a turbidity value of the wash water in the sump 100, sensed by the turbidity sensor 28, an amount of the generate foam, and whether the amount of the generated foam is greater than the threshold amount of foam. Thus, the dishwasher 1 may measure the amount of the foam generated in the wash space 12*a* accurately and rapidly without an additional device.

Though not illustrated in FIG. 4, in yet another embodiment, the controller may determine whether an amount of foam in the wash space 12*a* is greater than the threshold amount of foam further using a current value of the wash pump 150.

That is, in step 421, the current value of the wash pump 150 in the first time period is further sensed, and in step S423, the controller may determine whether the amount of foam in the wash space 12*a* is greater than the threshold amount of foam further based on the current value of the wash pump 150.

More specifically, when foam is generated in the wash space 12*a*, the wash water is not well circulated, and the current value of the wash pump 150 gradually decreases. Accordingly, even when the current value of the wash pump 150 is less than the preset threshold current value, It can be determined that the amount of foam is greater than threshold amount of foam.

2. Method of Removing Foam

Figure 8:
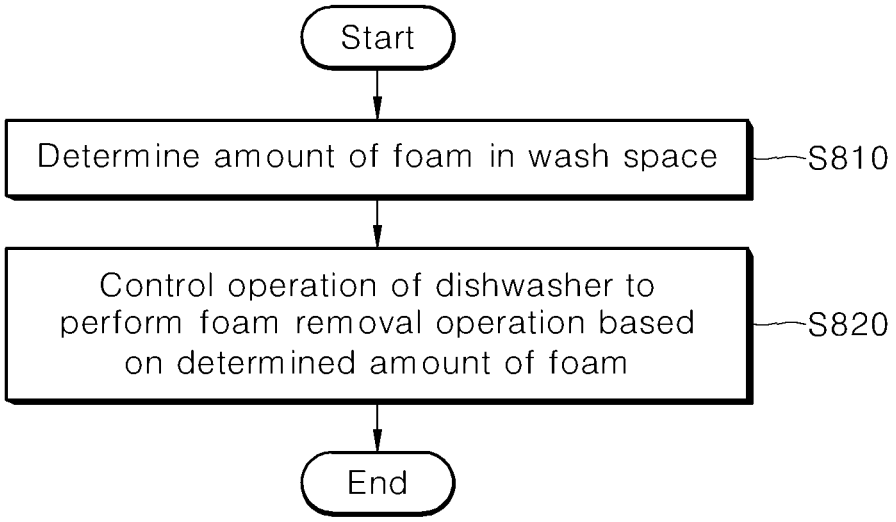
FIG. 8 is a view showing a flow chart of a control method of a dishwasher configured to remove foam in a wash space according to one embodiment.

FIG. 8 is a view showing a flow chart of a control method of a dishwasher 1 configured to remove foam in a wash space 12*a* according to one embodiment.

The control method of the dishwasher 1 for removing foam may be carried out in at least one of the pre-wash course, the main wash course, and the heating and rinsing course. For example, the control method of the dishwasher 1 for removing foam may be carried out after the method of determining an amount of foam is carried out in each of the pre-wash course, the main wash course, and the heating and rinsing course.

Each step of the control method of the dishwasher 1 for removing foam is described hereunder.

In step 810, an amount of foam in the wash space 12*a* may be determined. The step 810 may be performed by the controller.

For example, the controller may determine an amount of foam using a turbidity value of the wash water in the sump 100, sensed by the turbidity sensor 28, or using a current value of the wash pump 150 and the turbidity value of the wash water. Description in relation to this is provided above.

In step 820, operations of the dishwasher 1 may be controlled such that a foam removal operation is performed based on the determined amount of the foam. The controller may control the operations of the dishwasher 1.

In this case, the foam removal operation may be consecutively and repeatedly performed more than once. The number of times of performing the foam removal operation may be proportional to an amount of the foam in the wash space 12*a*. That is, a larger amount of foam in the wash space 12*a* may result in an increase in the frequency of the foam removal operation, and a smaller amount of foam in the wash space 12*a* may result in a decrease in the frequency of the foam removal operation.

In an example, when an amount of foam in the wash space 12*a* is less than the threshold amount of foam, the foam removal operation may not be carried out. In another example, when the user uses 3 g of ordinary detergent, the foam removal operation may be repeated five times. In another example, when the user uses 9 g of ordinary detergent, the foam removal operation may be repeated nine times. In yet another example, when the user uses 15 g of ordinary detergent, the foam removal operation may be repeated 14 times.

Further, the foam removal operation may be performed as a result of control over driving of the water supply valve 22, the plurality of spray arms 13, 14, 15, the wash pump 150, the drainage pump 250 and the like.

After the foam removal operation is performed more than once, the remaining operations (i.e., operations in the pre-wash course, or the main wash course, or the heating and rinsing course) of the dishwasher 1 may be continuously performed. That is, after the foam removal operation is performed more than once in case foam is generated in the pre-wash course, the remaining operations of the pre-wash course may be carried out; after the foam removal operation is performed more than once in case foam is generated in the main wash course, the remaining operations in the main wash course may be carried out; after the foam removal operation is performed more than once in case foam is generated in the heating and rinsing course, the remaining operations in the heating and rinsing course may be carried out.

In one embodiment, the foam removal operation may include a drainage operation by the drainage pump 250, a water supply operation by the water supply valve 22 and a wash operation by the wash pump 150 and the plurality of spray arms 13, 14, 15. In this case, the drainage operation, the water supply operation and the wash operation may be consecutively performed.

That is, the controller may control driving of the water supply valve 22, the plurality of spray arms 13, 14, 15, the wash pump 150 and the drainage pump 250 such that the foam removal operation is performed more than once, to remove the foam in the wash space 12*a* in each of the pre-wash course, the main wash course and the heating and rinsing course. The foam removal operation may include a drainage operation, a water supply operation and a wash operation that are consecutively performed.

The drainage operation may be a process of draining the wash water stored in the sump 100 outward.

In this case, the drainage operation may include a first drainage operation, an intermediate water supply operation and a second drainage operation. The first drainage operation, the intermediate water supply operation and the second drainage operation may be consecutively performed.

The first drainage operation may be a process of draining at least part of the wash water in the sump 100 by the drainage pump 250 outward. For example, the first drainage operation may be performed for 10 seconds.

The intermediate water supply operation may be process of supplying wash water to the sump 100 by the water supply valve 22 after the first drainage operation is carried out. Accordingly, the wash water may be further stored in the sump 100.

The second drainage operation may be a process of draining all the wash water stored in the sump 100 through the drainage pump 250 outward. For example, the second drainage operation may be performed for 10 seconds.

In summary, the drainage operation may be carried out twice to remove the foam. That is, when the drainage operation is performed once, the foam may be left on an inner wall and a lower surface of the sump 100, and the foam may not be effectively removed. According to the disclosure, the drainage operation may be performed twice such that the foam is removed efficiently.

The water supply operation may be a process of supplying wash water to the sump 100 through the water supply valve 22. For example, in the water supply operation, 3 L of wash water may be supplied to the wash space 12*a*.

The wash operation may be a process of spraying the wash water, stored in the sump 100, to the plurality of spray arms 13, 14, 15 by the wash pump 150.

In one embodiment, in the wash operation, the controller may control the wash pump 150 and the lower spray arm 13 to spray the wash water to the lower spray arm 13 among the plurality of spray arms 13, 14, 15. In this case, the upper spray arm 14 and the top spray arm 15 may not spray the wash water. That is, the controller may control the diverter valve 130 to spray the wash water only through the lower spray arm 13.

Figure 9:
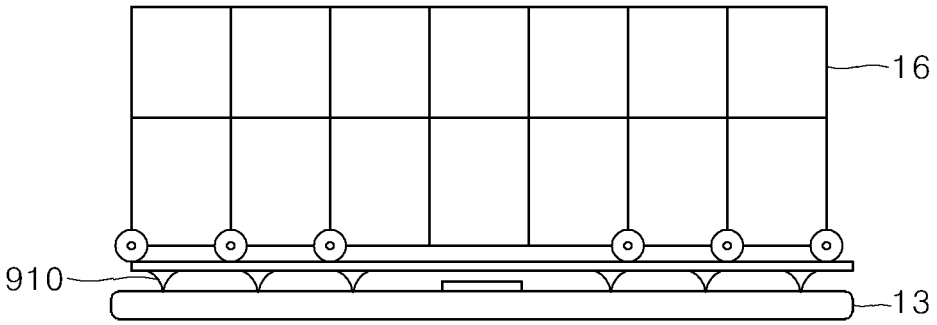
FIG. 9 is a view showing a concept of a lower spray arm's spraying wash water according to one embodiment.

FIG. 9 is a view showing a concept of spraying wash water 910 of the lower spray arm 13.

Referring to FIG. 1, in the wash operation, the controller may control driving of the lower spray arm 13 such that a maximum height of the wash water 910 sprayed from the lower spray arm 13 corresponds to a height of a lower surface of the lower rack 16. That is, the height of the wash water 910 sprayed from the lower spry arm 13 may be the same as the height of the lower rack 16 in a predetermined error range. In other words, a spray pressure of the wash water 910 sprayed from the lower spray arm 13 may be controlled by the controller to prevent the wash water from spraying over a bottom portion of the lower rack 16. In an example, the controller may set an RPM of a wash motor (not illustrated) in the wash pump 150 to 2000 to prevent the wash water 910, sprayed from the lower spray arm 13, from spraying over the bottom portion of the lower rack 16.

In summary, in the wash operation, when water is sprayed through all the top spray arm 15, the upper spray arm 14 and the lower spray arm 13, foam may be increased due to a spray pressure, a flow of the wash water and the like. According to the disclosure, the wash water is sprayed only to the row spray arm 13 among the plurality of spray arms 13, 14 and 15. Also, the height of the wash water (i.e., the spray pressure of the wash water) sprayed from the lower spray arm 13 is the same as the height of the lower rack 16 within the predetermined error range. Accordingly, the wash operation may be performed effectively.

In one embodiment, the foam removal operation may further include an intermittent wash operation performed between the water supply operation and the wash operation. The intermittent wash operation may be a process that is intermittently performed instead of being performed in all the foam removal operations. When the intermittent wash operation is further carried out, the foam may be removed more definitely.

As described above, when the foam removal operation is performed more than once, the controller may control the communicator such that at least one of information indicating that the foam removal operation is performed/completed more than once and information on extension of time for operation of the dishwasher 1 following the foam removal operation performed more than once is transmitted to an external terminal device or may control the input interface to display the at least one information.

According to the present disclosure, as the foam removal operation is performed more than once as described above, deterioration of wash performance and leakage of wash water caused by a large amounts of foam may be prevented, foam generated in the wash space 12*a* may be removed within a short period of time, and user convenience in use of the dishwasher 1 may be ensured without causing an operational error.

Even though all the components of the embodiment of the present disclosure are coupled as a single unit or coupled to operate as a single unit in the above description, the embodiment in the disclosure may not be limited. That is, among the components, one or more components may be optionally coupled to operate as one or more units within the range of the disclosure. In addition, although each of the components may be implemented as an independent hardware, some or all of the components may be optionally combined with each other, so that they can be implemented as a computer program having one or more program modules for executing some or all of the functions combined in one or more hardwares. Codes and code segments forming the computer program may be easily conceived by one skilled in the technical field of the disclosure. The computer program may implement the embodiments of the disclosure by being stored in a computer readable storage medium, and being read and executed by a computer. A magnetic recording medium, an optical recording medium, a storage medium including a semiconductor recording component, or the like may be employed as a storage medium of the computer program. Also, the computer program for implementing the embodiments of the present disclosure may include a program module that is transmitted in real time via an external device.

The embodiments have been described with reference to a number of illustrative embodiments thereof. However, the embodiment in the present disclosure may not be limited, and numerous other modifications and embodiments may be devised without departing from the technical spirit of the disclosure. Further, it should be understood that the effects and predictable effects based on the configurations in the disclosure are included within the range of the disclosure though not explicitly described in the description of the embodiments.

What is claimed is:

1. A method for controlling a dishwasher that includes a tub defining a wash space, a water supply valve configured to supply wash water to the wash space, a sump configured to store the wash water, a plurality of spray arms configured to spray the wash water, a plurality of racks disposed in the wash space, a wash pump configured to supply the wash water from the sump to the plurality of spray arms, a drainage pump configured to drain the wash water from the sump to an outside, a turbidity sensor configured to sense a turbidity value of the wash water in the sump, and a controller, the method comprising:

during a first time period, driving the wash pump and sensing a first turbidity value of the wash water in the sump;

during a second time period subsequent to the first time period, stopping driving of the wash pump and sensing a second turbidity value of the wash water in the sump;

determining a variation of the first turbidity value and a variation of the second turbidity value;

based on the variation of the first turbidity value and the variation of the second turbidity value, determining an amount of foam in the wash space and whether the amount of foam is greater than a threshold amount of foam; and based on determining that the amount of foam is greater than the threshold amount of foam, performing a foam removal operation that includes driving at least one of the water supply valve, the plurality of spray arms, the wash pump, or the drainage pump.

2. The method of claim 1, wherein the dishwasher is configured to perform a plurality of courses that includes a first course, the first course corresponding to a pre-wash course, a main wash course, or a heating and rinsing course, and wherein driving the washing pump comprises starting the driving of the washing pump at a start time point of the first course that corresponds to a start time point of the first time period.

3. The method of claim 1, wherein the turbidity sensor includes a light emitter configured to emit light, and a light receiver configured to receive light, each of the first turbidity value and the second turbidity value being inversely proportional to a voltage value corresponding to the light received by the light receiver, wherein sensing the first turbidity value comprises receiving a first voltage value from the turbidity sensor in the first time period, and wherein sensing the second turbidity value comprises receiving a second voltage value from the turbidity sensor in the second time period.

4. The method of claim 1, further comprising:

determining that the amount of foam is greater than the threshold amount of foam based on (i) the variation of the first turbidity value being greater than a first threshold variation and (ii) the variation of the second turbidity value being less than a second threshold variation.

5. The method of claim 4, wherein determining the variation of the first turbidity value and the variation of the second turbidity value comprises:

determining the variation of the first turbidity value based on at least one of an average gradient of the first turbidity value or a first difference value between the first turbidity value at a start of the first time period and a maximum value of the first turbidity value during the first time period, wherein the first threshold variation includes at least one of a first threshold turbidity gradient or a first threshold turbidity difference value; and determining the variation of the second turbidity value based on at least one of an average gradient of the second turbidity value in the second time period and a second difference value between the second turbidity value at a start of the second time period and a minimum value of the second turbidity value during the second time period, wherein the second threshold variation includes at least one of a second threshold turbidity gradient or a second threshold turbidity difference value.

6. The method of claim 5, wherein determining that the amount of foam is greater than the threshold amount of foam comprises:

determining that the amount of foam is greater than the threshold amount of foam based on (i) the average gradient of the first turbidity value being greater than the first threshold turbidity gradient and (ii) the average gradient of the second turbidity value being less than the second threshold turbidity gradient.

7. The method of claim 5, wherein determining that the amount of foam is greater than the threshold amount of foam comprises:

determining that the amount of foam is greater than the threshold amount of foam based on (i) the first difference value being greater than the first threshold turbidity difference value and (ii) the average gradient of the second turbidity value being less than the second threshold turbidity gradient.

8. The method of claim 5, wherein determining that the amount of foam is greater than the threshold amount of foam comprises:

determining that the amount of foam is greater than the threshold amount of foam based on (i) the average gradient of the first turbidity value being greater than the first threshold turbidity gradient and (ii) the second difference value being less than the second threshold turbidity difference value.

9. The method of claim 5, wherein determining that the amount of foam is greater than the threshold amount of foam comprises:

determining that the amount of foam is greater than the threshold amount of foam based on (i) the first difference value being greater than the first threshold turbidity difference value and (ii) the second difference value being less than the second threshold turbidity difference value.

10. The method of claim 1, further comprising sensing a current value of the wash pump based on driving the washing pump during the first time period, wherein determining the amount of foam comprises determining the amount of foam further based on the current value of the wash pump.

11. The method of claim 10, wherein determining the amount of foam further based on the current value of the wash pump comprises:

determining that the amount of foam is greater than the threshold amount of foam based on (i) the current value of the wash pump being less than a threshold current value, (ii) the variation of the first turbidity value being greater than a first threshold variation, and (iii) the variation of the second turbidity value being less than a second threshold variation.

12. The method of claim 1, wherein performing the foam removal operation comprises sequentially performing a drainage operation by the drainage pump, a water supply operation by the water supply valve, and a wash operation by the wash pump and the plurality of spray arms.

13. The method of claim 12, wherein the drainage operation comprises:

a first drainage operation comprising draining at least part of the wash water stored in the sump;

an intermediate water supply operation comprising supplying wash water to the sump; and a second drainage operation comprising draining all of the wash water stored in the sump.

14. The method of claim 12, wherein the water supply operation comprises supplying wash water to the sump by the water supply valve, and wherein the wash operation comprises supplying the wash water from the sump to the plurality of spray arms, and spraying the wash water through the plurality of spray arms.

15. The method of claim 14, wherein the plurality of spray arms comprise a lower spray arm disposed at a lowermost position among the plurality of spray arms, a top spray arm disposed at an uppermost position among the plurality of spray arms, and an upper spray arm disposed between the top spray arm the lower spray arm, and wherein spraying the wash water in the wash operation comprises spraying the wash water only through the lower spray arm among the plurality of spray arms.

16. The method of claim 15, wherein the plurality of racks include a lower rack disposed in a lower portion of the wash space, and wherein spraying the wash water through the lower spray arm comprises spraying the wash water to a lower surface of the lower rack or a position below the lower surface of the lower rack.

17. The method of claim 1, wherein performing the foam removal operation comprises:

repeating the foam removal operation; and increasing or decreasing a repetition times of the foam removal operation based on the amount of foam in the wash space.

18. A dishwasher comprising:

a tub that defines a wash space therein;

a water supply valve configured to supply wash water to the wash space;

a sump configured to store the wash water;

a plurality of spray arms configured to spray the wash water to the washing space, the sump being further configured to receive the wash water sprayed through the plurality of spray arms;

a plurality of racks disposed in the wash space;

a wash pump configured to supply the wash water from the sump to the plurality of spray arms;

a drainage pump configured to drain the wash water from the sump to an outside;

a turbidity sensor configured to sense a turbidity value of the wash water in the sump; and a controller configured to:

control the water supply valve, the plurality of spray arms, the wash pump, the drainage pump, and the turbidity sensor, during a first time period, drive the wash pump and sense a first turbidity value of the wash water in the sump, during a second time period subsequent to the first time period, stop driving the wash pump and sense a second turbidity value of the wash water in the sump, determine a variation of the first turbidity value and a variation of the second turbidity value, and based on the variation of the first turbidity value and the variation of the second turbidity value, determine an amount of foam in the wash space and whether the amount of foam is greater than a threshold amount of foam.

19. The dishwasher of claim 18, wherein the controller is configured to perform a plurality of courses that includes a first course, the first course corresponding to a pre-wash course, a main wash course, or a heating and rinsing course, wherein driving the washing pump comprises starting the driving of the washing pump at a start time point of the first course that corresponds to a start time point of the first time period, and wherein the controller is configured to:

determine the variation of the first turbidity value in the first time period based on at least one of an average gradient of the first turbidity value or a first difference value between the first turbidity value at the start time point of the first time period and a maximum value of the first turbidity value during the first time period, and determine the variation of the second turbidity value based on at least one of an average gradient of the second turbidity value in the second time period and a second difference value between the second turbidity value at a start time point of the second time period and a minimum value of the second turbidity value during the second time period.

20. The dishwasher of claim 18, wherein the controller is configured to, based on determining that the amount of foam is greater than the threshold amount of foam, operate at least one of the water supply valve, the plurality of spray arms, the wash pump, or the drainage pump to perform at least one foam removal operation.

* * * * *